US010221538B2

(12) United States Patent
Lutenegger et al.

(10) Patent No.: US 10,221,538 B2
(45) Date of Patent: Mar. 5, 2019

(54) HELICAL PILE LEADS AND EXTENSIONS

(71) Applicant: Hubbell Incorporated, Shelton, CT (US)

(72) Inventors: Alan James Lutenegger, Sunderland, MA (US); Gary Leonard Seider, Centralia, MO (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 14/553,733

(22) Filed: Nov. 25, 2014

(65) Prior Publication Data

US 2016/0145824 A1 May 26, 2016

(51) Int. Cl.
*E02D 13/02* (2006.01)
*E02D 5/80* (2006.01)
*E02D 7/22* (2006.01)

(52) U.S. Cl.
CPC ..... *E02D 13/02* (2013.01); *E02D 5/801* (2013.01); *E02D 7/22* (2013.01)

(58) Field of Classification Search
CPC .. E02D 5/801; E02D 5/56; E02D 7/22; E02D 2200/1671
See application file for complete search history.

(56) References Cited

U.S. PATENT DOCUMENTS 88,891 A * 4/1869 McMahen ..... E21B 7/001 175/170
5,575,593 A 11/1996 Raaf
5,707,180 A * 1/1998 Vickars ..... E02D 5/36 405/233
6,058,662 A * 5/2000 Perko ..... E02D 5/801 405/232
6,722,821 B1 4/2004 Perko et al.
7,441,471 B1 * 10/2008 Davis ..... E02D 7/22 405/303
7,510,350 B2 * 3/2009 Ronnkvist ..... E02D 5/801 405/231
7,635,240 B2 12/2009 Gantt
8,240,957 B1 * 8/2012 Watson, III ..... E02D 5/56 405/242
8,506,207 B2 8/2013 Lutenegger et al.
8,631,627 B2 1/2014 Atchley
8,777,521 B2 * 7/2014 Nagata ..... E02D 5/56 175/323
8,845,236 B1 * 9/2014 Dosdourian ..... E21B 10/44 175/19
2003/0041535 A1 3/2003 Rupiper
(Continued)

OTHER PUBLICATIONS

Stanier et al.; Modelling helical screw piles in soft clay and design implications; Jul. 2013; All pages (Year: 2013).*
(Continued)

*Primary Examiner* — Benjamin F Fiorello
(74) *Attorney, Agent, or Firm* — Wissing Miller LLP

(57) ABSTRACT

The present disclosure provides helical pile leads and extensions with closely spaced perimeter shear helical plates that develop a cylindrical failure surface between the perimeter shear helical plates and soil as the helical pile is rotated into the ground, mobilizing soil-to-soil shear strength, and thus increasing the stability, stiffness and load capacity of the helical pile.

17 Claims, 7 Drawing Sheets

(56) References Cited

U.S. PATENT DOCUMENTS

| | | | | |
|---|---|---|---|---|
| 2005/0074298 | A1* | 4/2005 | Jones | E02D 5/56 405/252.1 |
| 2012/0009022 | A1 | 1/2012 | Meline | |
| 2012/0037261 | A1* | 2/2012 | Nagata | E02D 5/56 138/177 |
| 2014/0286712 | A1 | 9/2014 | Lutenegger et al. | |

OTHER PUBLICATIONS

International Search Report and the Written Opinion of the International Searching Authority, or the Declaration mailed in PCT/US2015/062083 dated Feb. 5, 2016.

Lutennegger; Cylindrical Shear or Plate Bearing?—Uplift Behavior of Multi-Helix Screw Anchors in Clay; Department of Civil & Environmental Engineering,University of Massachusetts, 8 pages.

Lutenegger; Behavior of Multi-Helix Screw Anchors in Sand, Department of Civil & Environmental Engineering, University of Massachusetts, 2011 Pan-Am CGS Geotechnical Conference, 6 pages.

Merifield; Ultimate Lift Capacity of Multiplate Helical Anchors in Clay; Journal of Geotechnical and Geoenvironmental Engineering, Jul. 2011, 13 pages.

Rao et. al.; Uplift Capacity of Screw Pile Anchors; Geotechnical Engineering, vol. 20, 1989, 21 pages.

Stephenson; Helical Foundations and Tie Backs, Civil Engineering Department, University of Missouri-Rolla, Jun. 26, 1997, 34 pages.

Zhang et. al.; Screw Pile Test Program (Part 1): Instrumentation, Site Characterization and Installation; Department of Civil and Environmental Engineering, University of Alberta, Edmonton, AB; 51st Canadian Geotechnical Conference, 15 pages.

* cited by examiner

HELICAL PILE LEADS AND EXTENSIONS

BACKGROUND

Field

The present disclosure relates generally to helical piles, and more particularly to leads and extensions for helical piles having perimeter shear helical plates.

Description of the Related Art

Piles are used to support structures, such as buildings, when the soil underlying the structure would be too weak alone to support the structure. To effectively support a structure, a pile has to penetrate the soil to a depth where competent load-bearing stratum is found. Conventional piles can be cast in place by excavating a hole in the place where the pile is needed, or a hollow form can be driven into the ground where the pile is needed, and then filled with cement. These approaches are cumbersome and expensive.

Helical or screw piles are a cost-effective alternative to conventional cement piles because of the speed and ease at which a helical pile can be installed. Helical piles are rotated such that load bearing helical plates at the lower end of the pile effectively screw the pile into the soil to a desired depth. Referring to FIG. 1, a helical pile 10 is typically made of galvanized straight steel square or round shafts sequentially joined together. The bottom most piece of a helical pile is known as the lead 12, which has a lead head portion 14 and a lead end portion 16. The lead end portion 16 is configured to first penetrate the soil, and terminates at a pointed tip 17. As seen in FIGS. 1 and 2, the lead end portion 16 typically has one or more spaced apart load bearing helical plates 18 arranged on the lead shaft typically in the lead end portion 16 to penetrate the soil. The load bearing helical plates 18 on the lead may have the same diameter, or the load bearing helical plates may have different diameters that are in a tapered arrangement. For example, the tapered arrangement may be such that the smallest diameter load bearing helical plate is closest to the lead tip 17 and the largest load bearing helical plate is at a distance away from the lead tip. The load bearing helical plates 18 on the lead 12 are spaced apart at a distance "A" sufficient to promote individual plate load bearing capacity. Typically, the distance "A" is three times the diameter of the smallest load bearing helical plate 18 on the shaft of the lead 12. The diameter of the load bearing helical plates 18 in conventional helical piles may range from between about 6 inches and about 16 inches depending upon the load the pile is to carry. As noted above, helical piles 10 are installed by applying torque to the shaft at the lead head 14 that causes the load bearing helical plates to rotate and screw into the soil with minimal disruption to the surrounding soil. As the lead 12 penetrates the soil, one or more extensions 20 may have to be added to the pile 10 so that the pile can achieve the desired depth and load capacity. Referring to FIG. 1, extensions 20 may be fabricated from traditional straight steel square or round shafts and have an extension end portion 22 and an extension head portion 24 that are configured to connect to a lead head portion 14 and/or another extension 20, typically with a nut and bolt. Referring to FIG. 3, the extensions 20 may have load bearing helical plates 26 spaced apart at a distance "A" sufficient to promote individual plate load bearing capacity. As noted above, typically, the distance "A" is three times the diameter of the smallest load bearing helical plate 26 on the shaft of the extension 12. The diameter of the load bearing helical plates 26 in conventional helical pile extensions may range from between about 12 inches and about 16 inches depending upon the load the pile is to carry. Typically, the load bearing plates 26 on extension 20 are the same diameter as the largest load bearing helical plate on the lead 12.

One drawback of conventional helical piles is that they have a limited load capacity that if exceeded can cause the helical pile to settle or creep. Another drawback of conventional helical piles is that they can succumb to lateral movement. Greater pile stability and stiffness can be achieved by pouring or pumping cement based grout around the pile shaft which hardens to form a grout column. However, adding grout columns increase construction costs from a time and materials point of view. Further, there may be instances where soil conditions or other environmental conditions do not permit the use of grout columns to increase the stability, stiffness, and load capacity of the pile. The present disclosure provides an alternative to using grout columns to increase the stability, stiffness and load capacity of helical piles.

SUMMARY

The present disclosure provides helical piles having helical pile leads and/or extensions with closely spaced perimeter shear helical plates that develop a cylindrical failure surface between the perimeter shear helical plates and soil, mobilizing soil-to-soil shear strength, and thus increasing the stability, stiffness and load capacity of the helical pile. In one embodiment, the helical pile extension includes a shaft having an end portion configured to connect to another helical pile extension or a helical pile lead, and a head portion configured to connect to another helical pile extension. A plurality of perimeter shear helical plates are attached to the shaft, and spaced apart a distance that promotes soil-to-soil shear strength. An example of a distance that promotes soil-to-soil shear strength is less than 3 times a diameter of the perimeter shear helical plates and preferably 1.5 times a diameter of the perimeter shear helical plates. The extension shafts may be square or round and they may be solid or hollow. The diameter of each of the plurality of perimeter shear helical plates can range from between about 4 inches and about 10 inches.

In one embodiment, the helical pile lead includes a shaft having an end portion and a head portion, where the head portion is configured to connect to a helical pile extension. At least one load bearing helical plate is attached at the end portion of the shaft, and a plurality of perimeter shear helical plates are attached to the shaft. The perimeter shear helical plates on the shaft are preferably spaced apart a distance that promotes soil-to-soil shear strength. Preferably, the perimeter shear helical plate closest to the at least one load bearing plate is spaced from the at least one load bearing helical plate a distance that promotes the individual load bearing capacity of the at least one load bearing helical plate. An example of a distance that promotes soil-to-soil shear strength is less than 3 times a diameter of the perimeter shear helical plates, and preferably 1.5 times a diameter of the perimeter shear helical plates. An example of a distance that promotes the individual load bearing capacity of the at least one load bearing helical plate is at least 6 inches. The diameter of each of the plurality of perimeter shear helical plates can range between about 4 inches and 10 inches, and the diameter of the at least one load bearing helical plate can range between 12 inches and 16 inches.

In one embodiment, a helical pile according to the present disclosure may include a lead having a lead shaft with an end portion, a head portion configured to connect to an extension, and at least one load bearing helical plate attached at the end portion of the lead shaft. The helical pile also includes an extension having an extension shaft with an end portion that is configured to connect to the head portion of the lead. The extension also has a head portion, and a plurality of perimeter shear helical plates attached to the extension shaft. The perimeter shear helical plates on the extension shaft are preferably spaced apart a distance that promotes soil-to-soil shear strength, and the perimeter shear helical plate on the extension shaft closest to the lead is spaced from the at least one load bearing helical plate a distance that promotes the individual load bearing capacity of the at least one load bearing helical plate. An example of a distance that promotes soil-to-soil shear strength is less than 3 times a diameter of the perimeter shear helical plates and preferably 1.5 times a diameter of the perimeter shear helical plates. An example of a distance that promotes the individual load bearing capacity of the at least one load bearing helical plate is at least 6 inches. Preferably, the diameter of each of the plurality of perimeter shear helical plates ranges from between 4 inches and 10 inches, and the diameter of the at least one load bearing helical plate ranges from between 12 inches and 16 inches.

In another embodiment, a helical pile according to the present disclosure may include a lead having a lead shaft with an end portion, and a head portion configured to connect to an extension, at least one load bearing helical plate attached at the end portion of the lead shaft, and a plurality of perimeter shear helical plates attached to the shaft. The perimeter shear helical plates on the lead shaft are preferably spaced apart a distance that promotes soil-to-soil shear strength, and the perimeter shear helical plate closest to the at least one load bearing plate is preferably spaced from the at least one load bearing helical plate a distance that promotes the individual load bearing capacity of the at least one load bearing helical plate. The helical pile according to this embodiment also includes an extension having an extension shaft with an end portion configured to connect to the head portion of the lead, and a head portion.

BRIEF DESCRIPTION OF THE DRAWINGS

The figures depict embodiments for purposes of illustration only. One skilled in the art will readily recognize from the following description that alternative embodiments of the structures illustrated herein may be employed without departing from the principles described herein, wherein.

DETAILED DESCRIPTION

The present disclosure provides helical leads and extensions with closely spaced perimeter shear helical plates capable of developing a cylindrical failure surface between the perimeter shear helical plates and soil to mobilize soil-to-soil shear strength. The helical leads and extensions disclosed herein can be used as helical piles or anchors, and are capable of withstanding compression loads and tension loads. Reference herein to helical lead, helical extension, and helical piles also includes helical anchors.

Figure 3:
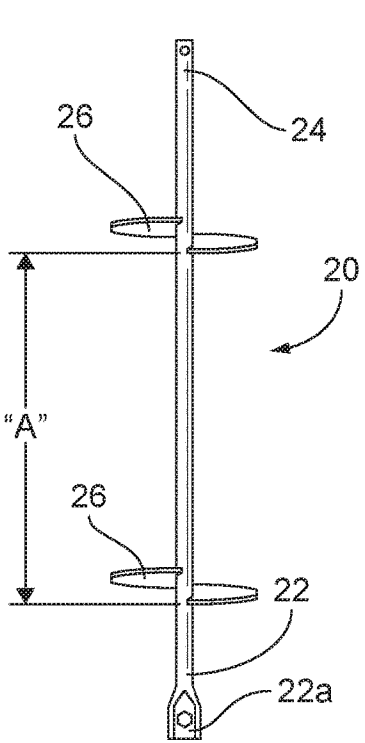
FIG. 3 PRIOR ART
FIG. 3 is a side view of a conventional helical pile extension with multiple load bearing helical plates.
Figure 2:
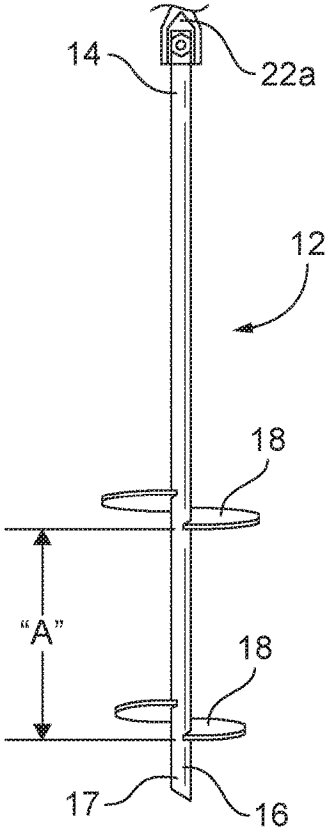
FIG. 2 PRIOR ART
FIG. 2 is a side view of a conventional helical pile lead with multiple load bearing helical plates.
Figure 1:
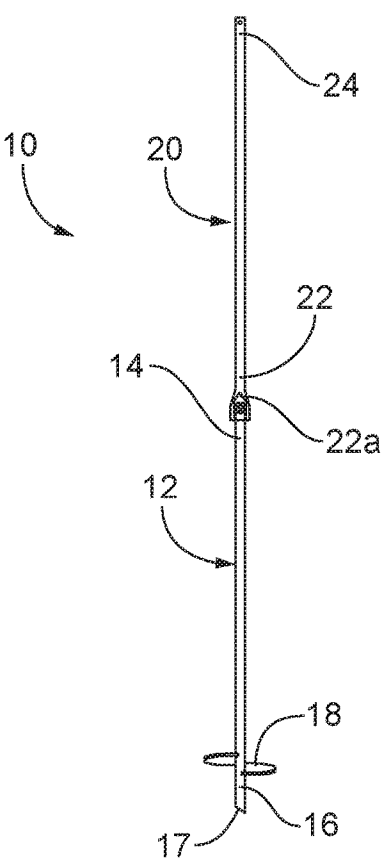
FIG. 1 PRIOR ART
FIG. 1 is a side view of a conventional helical pile with a single load bearing helical plate lead, and a straight extension attached to the lead.
Figure 4:
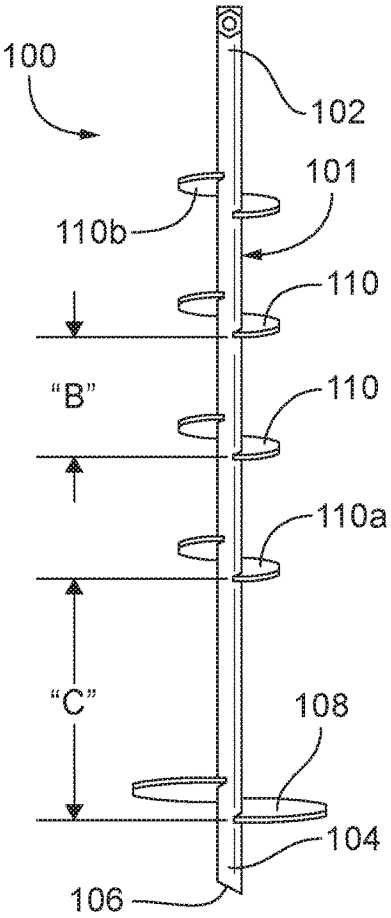
FIG. 4 is a side view of an embodiment according to the present disclosure of a helical pile lead with multiple perimeter shear helical plates along a length of the lead.

Referring to FIG. 4, an exemplary embodiment of a lead for helical piles according to the present disclosure is shown. In this embodiment, the lead 100 may be fabricated from steel or galvanized steel, straight square or round shafts 101. The length of the shaft 101 may be between 3 feet and 10 feet, and the length of a lead for a particular installation would depend upon the load the pile is to carry and the type of equipment used for installation. The lead 100 has a lead head portion 102 and a lead end portion 104 that preferably terminates in a pointed tip 106. The lead head portion 102 is configured to connect to an extension, such as extension 200 (shown in FIG. 6), or a conventional extension 20 (shown in FIG. 1). Typically, the lead is connected to an extension using a nut and bolt, and preferably a galvanized nut and bolt. In the embodiment shown, the square or round lead head portion 102 fits within a female receptacle **204*a* in an extension 200 or an extension 12, and the nut is passed through holes aligned in the lead head portion and the extension female receptacle 204*a***.

In the lead end portion 104 is one or more load bearing helical plates 108 that when rotated screw the pile into the soil with minimal disruption to the surrounding soil. The load bearing helical plates 108 on the lead may have the same diameter, or the load bearing helical plates 108 may have different diameters that are in a tapered arrangement. For example, the tapered arrangement may be such that the smallest diameter load bearing helical plate is closest to the lead tip 106 and the largest load bearing helical plate is at a distance away from the lead tip. If multiple load bearing helical plates are employed, the load bearing helical plates on the lead would be spaced apart at a distance "A" sufficient to promote individual plate load bearing capacity, as described above. In the embodiment of FIG. 4, a single load bearing helical plate 108 for the lead 100 is shown. The present disclosure also contemplates leads with multiple load bearing helical plates, where the distance between the load bearing helical plates 108 is preferably a multiple of, e.g., three times, the diameter of the lower load bearing helical plate. For example, if the lower load bearing helical plate is 10 inches in diameter the distance to the next load bearing helical plate would be 3 times the diameter of that plate, which is 30 inches.

The lead 100 in this embodiment has a plurality of spaced apart perimeter shear helical plates 110 arranged along the length of the lead shaft 101, as shown. The perimeter shear helical plates are typically welded to the shaft 101, but the perimeter shear helical plates may be secured to the shaft using any other suitable method. The lowest perimeter shear helical plate 110*a* on lead shaft 101 is positioned on the lead shaft at a distance "C" from the load bearing helical plate 108. The distance "C" is sufficient to promote the individual plate load bearing capacity of plate 108, which is typically 1½ feet to 2 feet. Each perimeter shear helical plate 110 can have the same diameter, or different diameters in a tapered arrangement. In the embodiment shown in FIG. 4, the perimeter shear helical plates 110 have the same diameter. Preferably, the diameter of each perimeter shear helical plate 110 is less than the diameter of the load bearing helical plates 108. Suitable diameters for the perimeter shear helical plates 110 on the lead 100 can range from between about 4 inches and about 10 inches, depending upon the diameter of the load bearing helical plate or plates on the lead, and the desired load capacity.

Figure 5:
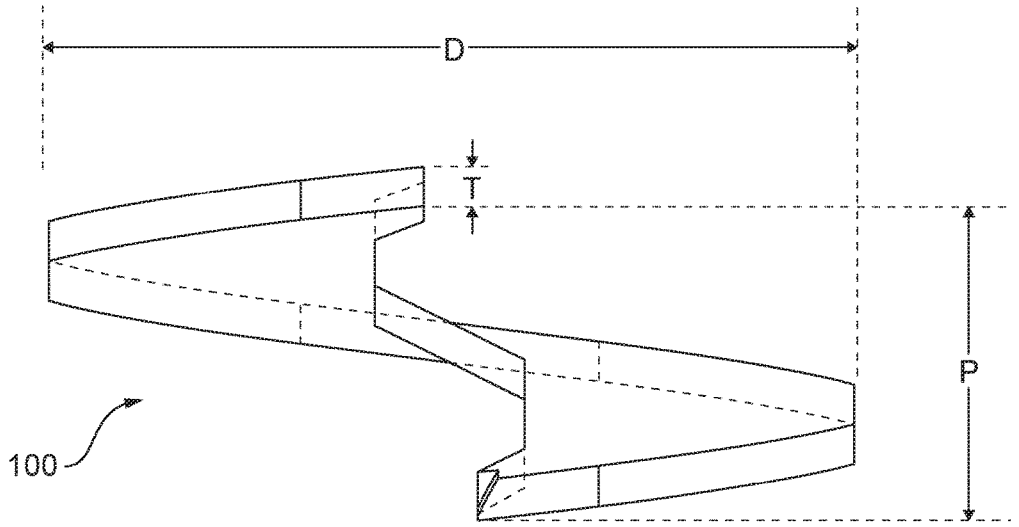
FIG. 5 is a perspective view of an embodiment of a perimeter shear helical plate according to the present disclosure.

FIG. 5 illustrates an exemplary perimeter shear helical plate 110. In this exemplary embodiment, the perimeter shear helical plate has a diameter "D" which is sufficient to promote soil-to-soil shear strength. Preferably, the diameter of the perimeter shear helical plate ranges between about 4 inches and about 10 inches. The perimeter shear helical plate has a helical pitch "P" of between about 2 inches and about 4 inches, and preferably about 3 inches. It is also preferred that the helical pitch "P" of the perimeter shear helical plates is substantially the same as the helical pitch of the load bearing helical plates used on the lead. The thickness 'T' of each perimeter shear helical plate is between about ⅜ inch and about ½ inch.

Referring again to FIG. 4, the perimeter shear helical plates 110 are spaced apart along the shaft 101 at a distance "B" sufficient to promote soil-to-soil shear strength. Preferably, the distance "B" is less than 3 times a diameter of the perimeter shear helical plates 110, and preferably equal to 1.5 times the diameter of the perimeter shear helical plates 110. For example, if the perimeter shear helical plates were 6 inches in diameter and using a distance "B" that is 1.5 times the diameter of the perimeter shear helical plates, the spacing between the perimeter shear helical plates along the shaft 101 would be less than or equal to 9 inches. By closely spacing the perimeter shear helical plates 110 at the distance "B", a cylindrical failure surface between the perimeter shear helical plates 110 and the soil develops as the helical pile is rotated into the ground mobilizing soil-to-soil shear strength, and thus increasing the stability, stiffness and load capacity of the helical pile.

Figure 6:
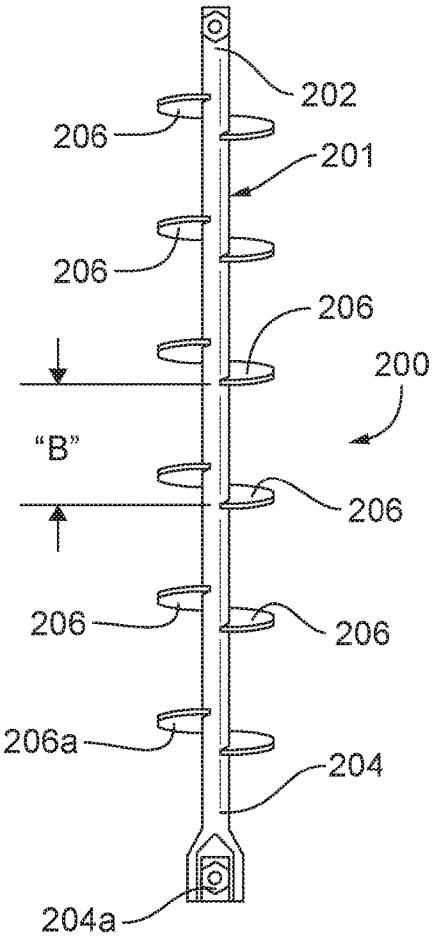
FIG. 6 is a side view of an embodiment according to the present disclosure of a helical pile extension with multiple perimeter shear helical plates along a length of the extension.

Referring to FIG. 6, an exemplary embodiment of an extension for helical piles according to the present disclosure is shown. In this embodiment, the extension 200 may be fabricated from steel or galvanized steel, straight square or round shafts 201, which can be hollow or solid shafts. The length of the shaft 201 may be between 3 feet and 10 feet, and the length of an extension for a particular installation would depend upon the load the pile is to carry and the type of equipment used for installation. The extension 200 has an extension head portion 202 and an extension end portion 204. The extension head portion 202 is configured to connect to another extension or with a lead. The extension end portion 204 is also configured to couple with another extension or with a lead. The extension 200 may be connected to another extension or a lead with a nut and bolt, preferably a galvanized nut and bolt. In the embodiment shown, the square or round lead head portion 102 would fit within the female receptacle 204*a* in extension 200, and the nut is passed through holes aligned in the extension female receptacle 204*a* and the lead head.

The extension 200 has a plurality of spaced apart perimeter shear helical plates 206 arranged along the length of the extension shaft 201, as shown. The perimeter shear helical plates are typically welded to the shaft 201, but the perimeter shear helical plates may be secured to the shaft using any other suitable method. The perimeter shear helical plates 206 are substantially similar to perimeter shear helical plates 110 on the lead 100 and shown in more detail in FIG. 5. Each perimeter shear helical plate 206 can have the same diameter, or different diameters in a tapered arrangement. In the embodiment shown in FIG. 6, the perimeter shear helical plates 206 have the same diameter. Preferably, the diameter of the perimeter shear helical plates 206 are less than the diameter of the load bearing helical plates on the lead. Suitable diameters for the perimeter shear helical plates 206 on the extension 200 can range from between about 4 inches and about 10 inches, depending upon the diameter of the load bearing helical plate or plates on the lead and the load capacity required.

The perimeter shear helical plates 206 are spaced apart along the shaft 201 at a distance "B" sufficient to promote soil-to-soil shear strength. Preferably, the distance "B" is less than 3 times a diameter of the perimeter shear helical plates 110, and preferably equal to 1.5 times the diameter of the perimeter shear helical plates 206. For example, if the perimeter shear helical plates were 8 inches in diameter and using a distance "B" that is 1.5 times the diameter of the perimeter shear helical plates, the spacing between the perimeter shear helical plates 206 along the shaft 201 would be less than or equal to 12 inches. By closely spacing the perimeter shear helical plates 206 at the distance "B" a cylindrical failure surface between the perimeter shear helical plates 206 and soil develops as the helical pile is rotated into the soil mobilizing soil-to-soil shear strength, and thus increasing the stability, stiffness and load capacity of the helical pile.

Figure 7:
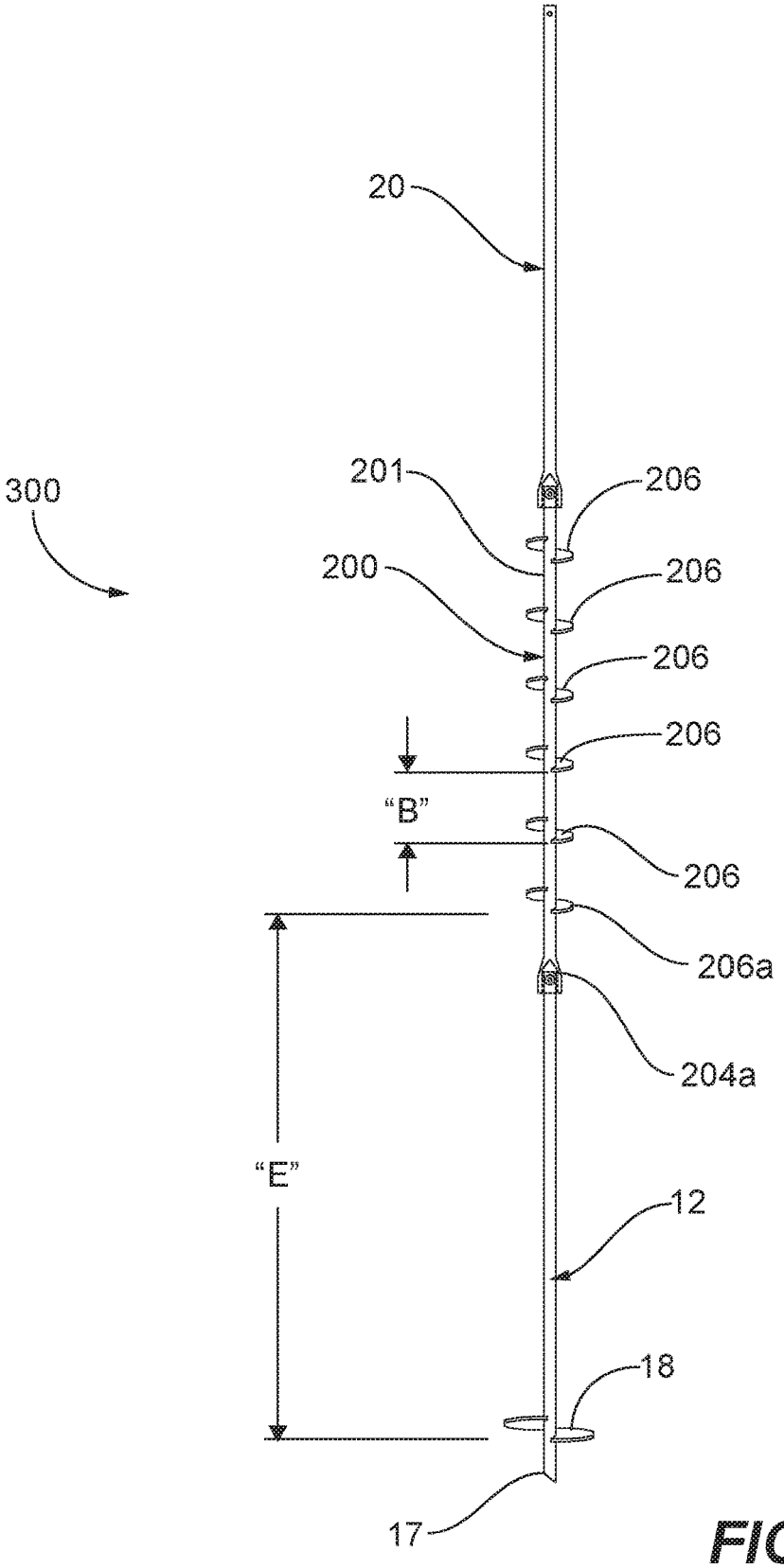
FIG. 7 is a side view of an embodiment according to the present disclosure of a helical pile having a lead with a single load bearing helical plate, an extension with perimeter shear helical plates, and a straight extension.

Referring now to FIG. 7, an exemplary embodiment of a helical pile 300 according to the present disclosure is shown. In this embodiment, the helical pile 300 includes a single load bearing helical plate 18 on a lead 12, and extension 200 connected to the lead 12, and an extension 20 connected to the extension 200. In this embodiment, the lowest perimeter shear helical plate 206*a* on the extension shaft 201 is spaced a distance "E" from the lowest load bearing helical plate 18 on the lead shaft. The distance "E" is determined by the soil conditions, and is typically greater than 1 foot.

Figure 8:
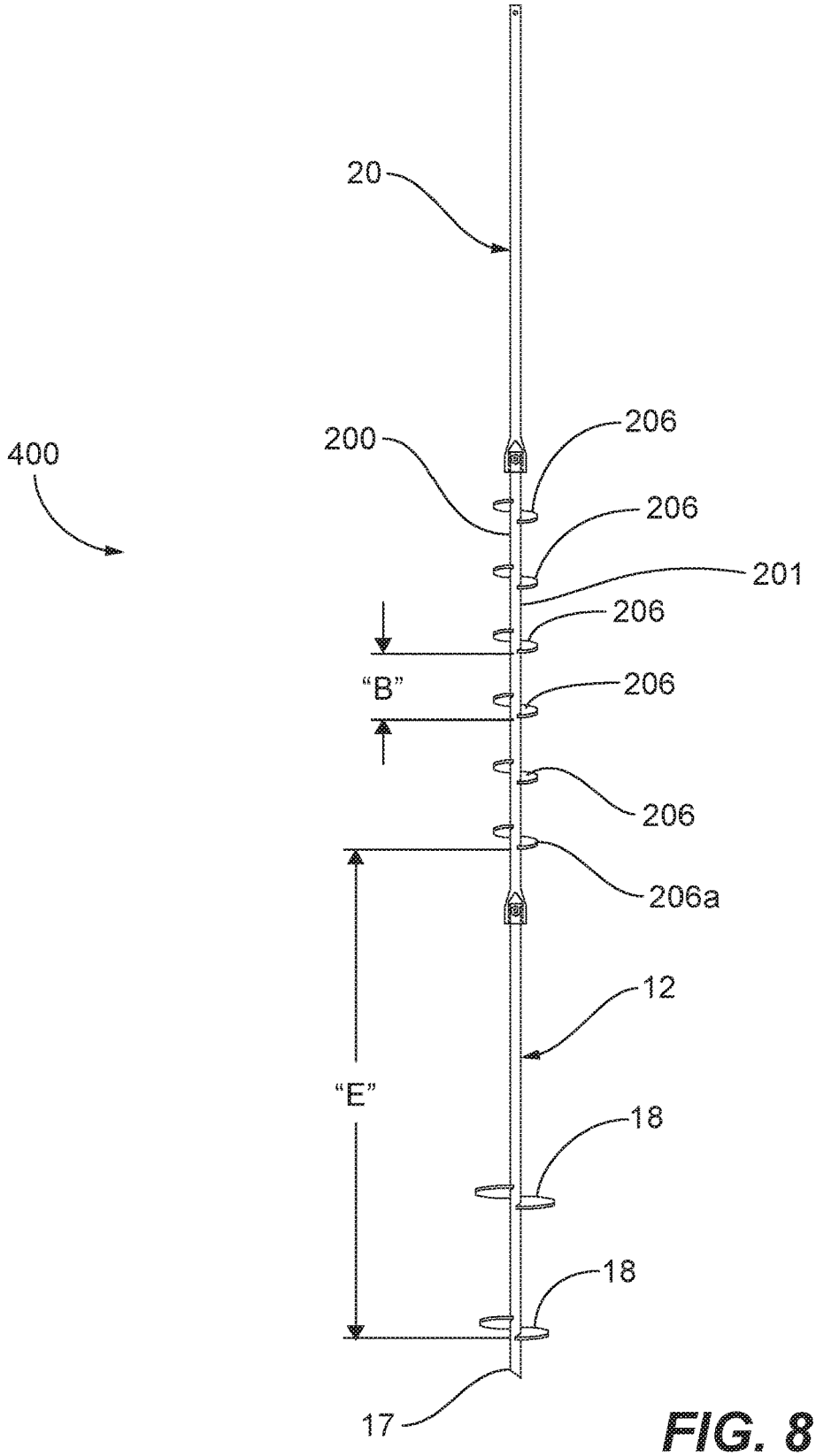
FIG. 8 is a side view of an embodiment according to the present disclosure of a helical pile having a lead with two load bearing helical plates, an extension with perimeter shear helical plates, and a straight extension.

Referring to FIG. 8, an exemplary embodiment of a helical pile 400 according to the present disclosure is shown. In this embodiment, the helical pile 400 includes two load bearing helical plates 18 on a lead 12, and extension 200 connected to the lead 12, and an extension 20 connected to the extension 200. In this embodiment, the lowest perimeter shear helical plate 206*a* on the extension shaft 201 is spaced a distance "E" from the lowest load bearing helical plate 18 on the lead shaft. The distance "E" is determined by the soil conditions, and is typically greater than 1 foot.

Figure 9:
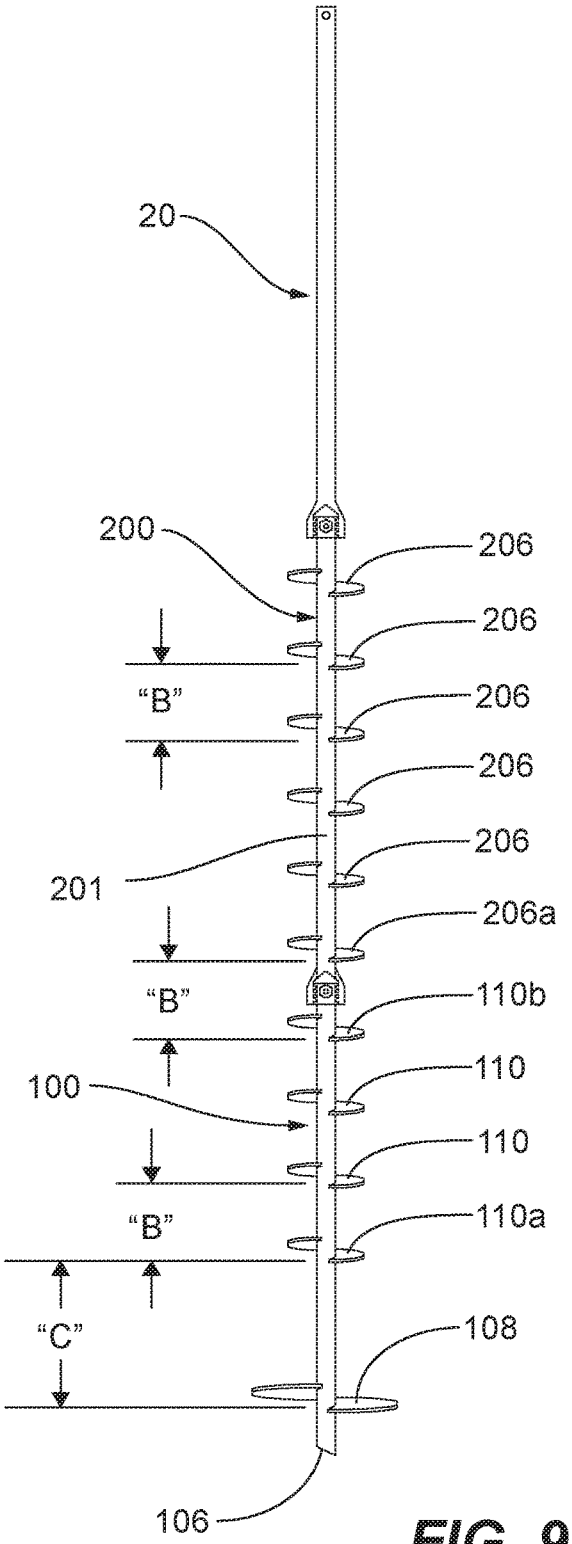
FIG. 9 is a side view of an embodiment according to the present disclosure of a helical pile having a lead with a single load bearing helical plate and perimeter shear helical plates, an extension with perimeter shear helical plates, and a straight extension.

Referring to FIG. 9, an exemplary embodiment of a helical pile 500 according to the present disclosure is shown. In this embodiment, the helical pile 500 includes a single load bearing helical plate 108 on a lead 100, and extension 200 connected to the lead 100, and an extension 20 connected to the extension 200. In this embodiment, the lowest perimeter shear helical plate 110*a* on the lead shaft 101 is spaced a distance "C" from the lowest load bearing helical plate 108 on the lead shaft 101, as described above. Further, the lowest perimeter shear helical plate 206*a* on extension shaft 201 is spaced the distance "B" from the upper most perimeter shear helical plate 110*b* on the lead shaft 101.

Figure 10:
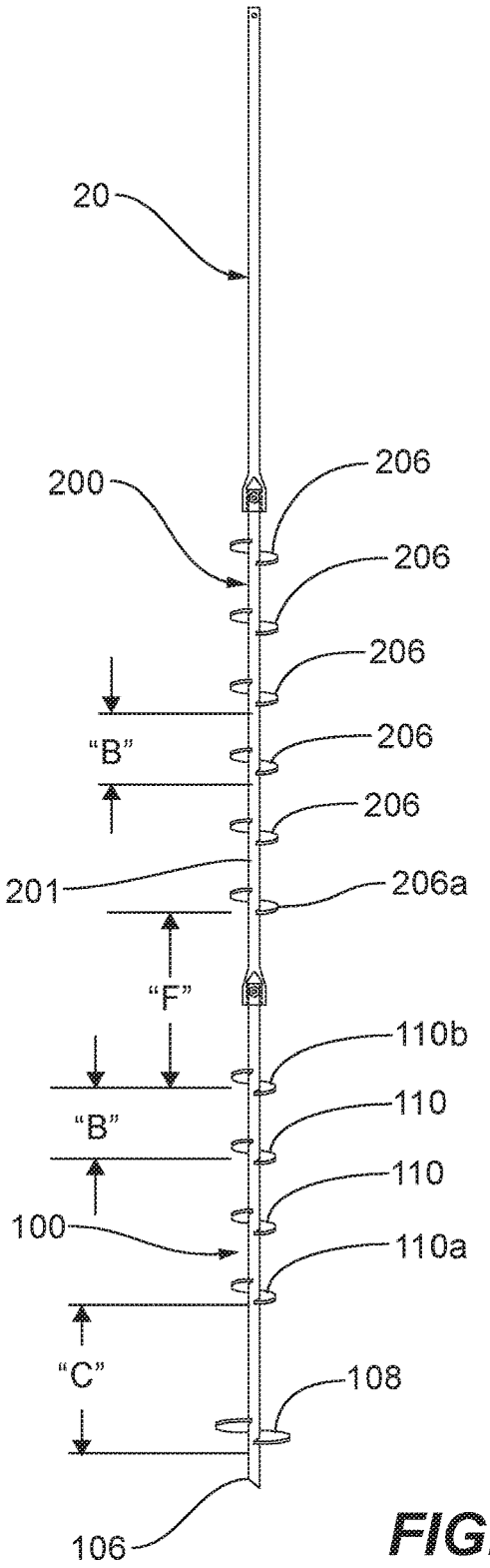
FIG. 10 is a side view of another embodiment of the helical pile of FIG. 9.

Referring to FIG. 10, an exemplary embodiment of a helical pile 600 according to the present disclosure is shown. In this embodiment, the helical pile 600 includes a single load bearing helical plate 108 on a lead 100, and extension 200 connected to the lead 100, and an extension 20 connected to the extension 200. In this embodiment, the lowest perimeter shear helical plate 110*a* on the lead shaft 101 is spaced a distance "C" from the lowest load bearing helical plate 108 on the lead shaft 101, as described above. Further, the lowest perimeter shear helical plate 206*a* on extension shaft 201 is spaced a distance "F" from the upper most perimeter shear helical plate 110*b* on the lead shaft 101. The distance "F" is preferably twice the distance "B".

Other embodiments of the helical pile according to the present disclosure may include a plurality of extensions 200 connected in series to lead 12 or lead 100, or the helical pile may include one or more extensions 200 with one or more extensions 20 connected to the lead 12 or lead 100 in various combinations and arrangements. For example, an alternating arrangement may be employed where an extension 200 is connected to a lead 100 or 12, and then an extension 20 is connected to the extension 200, and then an extension 200 is connected to the extension 20, and so on. As another example, an alternating arrangement may be employed where an extension 20 is connected to a lead 100 or 12, and then an extension 200 is connected to the extension 20, and then an extension 20 is connected to the extension 200, and so on.

Helical piles are installed by applying torque to the shaft at the lead head portion that causes the load bearing helical plates to rotate and screw into the soil with minimal disruption to the surrounding soil. As the lead penetrates the soil, one or more extensions may have to be added to the pile so that the pile can achieve the desired depth.

The helical piles, leads and extensions using the perimeter shear helical plates as described herein provide solutions to develop a cylindrical failure surface between the perimeter shear helical plates and soil as the helical pile is rotated into the soil mobilizing soil-to-soil shear strength, and thus increasing the stability, stiffness and load capacity of the helical piles. The particular configuration of piles, leads and extensions used as well as the diameters of the load bearing helical plates and the perimeter shear helical plates will depend upon the load the piles are to bear, and the soil conditions. However, it will be understood that various modifications can be made to the embodiments of the present disclosure herein without departing from the spirit and scope thereof. Therefore, the above description should not be construed as limiting the disclosure, but merely as embodiments thereof. Those skilled in the art will envision other modifications within the scope and spirit of the invention as defined by the claims appended hereto.

What is claimed is:

1. A helical pile, comprising:

a lead having a lead shaft with an end portion, a head portion configured to connect to an extension, and at least one load bearing helical plate attached at the end portion of the lead shaft; and an extension having an extension shaft with an end portion configured to connect to the head portion of the lead, a head portion, and a plurality of perimeter shear helical plates each having the same diameter that is less than a diameter of the at least one load bearing helical plate, the plurality of perimeter shear helical plates being attached to the extension shaft, each perimeter shear helical plate having a leading edge and a trailing edge separated from the leading edge a distance substantially equal to a pitch of the helical plate;

wherein the plurality of perimeter shear helical plates on the extension shaft are spaced apart on the extension shaft a distance of less than three times the diameter of the perimeter shear helical plates so as to facilitate the creation of a cylindrical failure surface between the plurality of perimeter shear helical plates and soil when the helical pile extension is driven into the ground; and wherein the perimeter shear helical plate on the extension shaft closest to the lead is spaced from the at least one load bearing helical plate a distance that promotes the individual load bearing capacity of the at least one load bearing helical plate.

2. The helical pile according to claim 1, wherein the distance that creates a cylindrical failure surface between the plurality of perimeter shear helical plates and soil is equal to about 1.5 times the diameter of the perimeter shear helical plates.

3. The helical pile according to claim 1, wherein the distance that promotes the individual load bearing capacity of the at least one load bearing helical plate is greater than one foot.

4. The helical pile according to claim 1, wherein the lead shaft is square.

5. The helical pile according to claim 1, wherein the lead shaft is round.

6. The helical pile according to claim 1, wherein the extension shaft is square.

7. The helical pile according to claim 1, wherein the extension shaft is round.

8. The helical pile according to claim 1, wherein a diameter of each of the plurality of perimeter shear helical plates ranges between about 4 inches and about 10 inches.

9. The helical pile according to claim 1, wherein a diameter of the at least one load bearing helical plate ranges between about 12 inches and about 16 inches.

10. A helical pile, comprising:

a lead having, a lead shaft with an end portion and a head portion, wherein the head portion is configured to connect to an extension;

at least one load bearing helical plate attached at the end portion of the lead shaft; and a plurality of perimeter shear helical plates each having the same diameter that is less than a diameter of the at least one load bearing helical plate, the plurality of perimeter shear helical plates being attached to the lead shaft, each perimeter shear helical plate having a leading edge and a trailing edge separated from the leading edge a distance substantially equal to a pitch of the helical plate;

wherein the plurality of perimeter shear helical plates on the lead shaft are spaced apart on the lead shaft a distance of less than three times the diameter of the perimeter shear helical plates so as to facilitate the creation of a cylindrical failure surface between the plurality of perimeter shear helical plates and soil when the helical pile is driven into the ground; and wherein the perimeter shear helical plate closest to the at least one load bearing plate is spaced from the at least one load bearing helical plate a distance that promotes the individual load bearing capacity of the at least one load bearing helical plate; and an extension having, an extension shaft with an end portion configured to connect to the head portion of the lead, and a head portion;

a plurality of perimeter shear helical plates each having the same diameter that is less than a diameter of the at least one load bearing helical plate, the plurality of perimeter shear helical plates being attached to the extension shaft, each perimeter shear helical plate having a leading edge and a trailing edge separated from the leading edge a distance substantially equal to a pitch of the helical plate;

wherein the plurality of perimeter shear helical plates on the extension shaft are spaced apart on the extension shaft a distance of less than three times the diameter of the perimeter shear helical plates so as to facilitate the creation of a cylindrical failure surface between the plurality of perimeter shear helical plates and soil when the helical pile extension is driven into the ground.

11. The helical pile according to claim 10, wherein the distance that creates a cylindrical failure surface between the plurality of perimeter shear helical plates attached to the lead shaft and to the extension shaft and soil is equal to about 1.5 times the diameter of the perimeter shear helical plates.

12. The helical pile according to claim 10, wherein the lead shaft is square.

13. The helical pile according to claim 10, wherein the lead shaft is round.

14. The helical pile according to claim 10, wherein the extension shaft is square.

15. The helical pile according to claim 10, wherein the extension shaft is round.

16. The helical pile according to claim 10, wherein a diameter of each of the plurality of perimeter shear helical plates attached to the lead shaft and to the extension shaft ranges between about 4 inches and about 10 inches.

17. The helical pile according to claim 10, wherein the diameter of the at least one load bearing helical plate ranges between about 12 inches and about 16 inches.

* * * * *